United States Patent [19]

Yan

[11] 3,968,023

[45] July 6, 1976

[54] PRODUCTION OF LUBRICATING OILS

[75] Inventor: Tsoung-Yuan Yan, Trenton, N.J.

[73] Assignee: Mobil Oil Corporation, New York, N.Y.

[22] Filed: Jan. 30, 1975

[21] Appl. No.: 545,655

[52] U.S. Cl. ..... 208/86; 208/18; 208/87; 208/93; 208/312

[51] Int. Cl.[2] ..... C10G 37/00

[58] Field of Search ..... 208/18, 86, 87, 312, 208/92, 93

[56] References Cited

UNITED STATES PATENTS

| | | | |
|---|---|---|---|
| 2,847,353 | 8/1958 | Beavon | 208/86 |
| 2,886,523 | 5/1959 | Claridge et al. | 208/312 |
| 3,349,028 | 10/1967 | Burch | 208/312 |
| 3,723,295 | 3/1973 | Kress | 208/18 |

*Primary Examiner*—Herbert Levine
*Attorney, Agent, or Firm*—Charles A. Huggett; Carl D. Farnsworth

[57] ABSTRACT

Residual oils are upgraded to lube oil base stocks by a combination process involving deasphalting, solvent extraction and hydrocracking arranged to particularly promote the efficient production of lube oil products.

5 Claims, 1 Drawing Figure

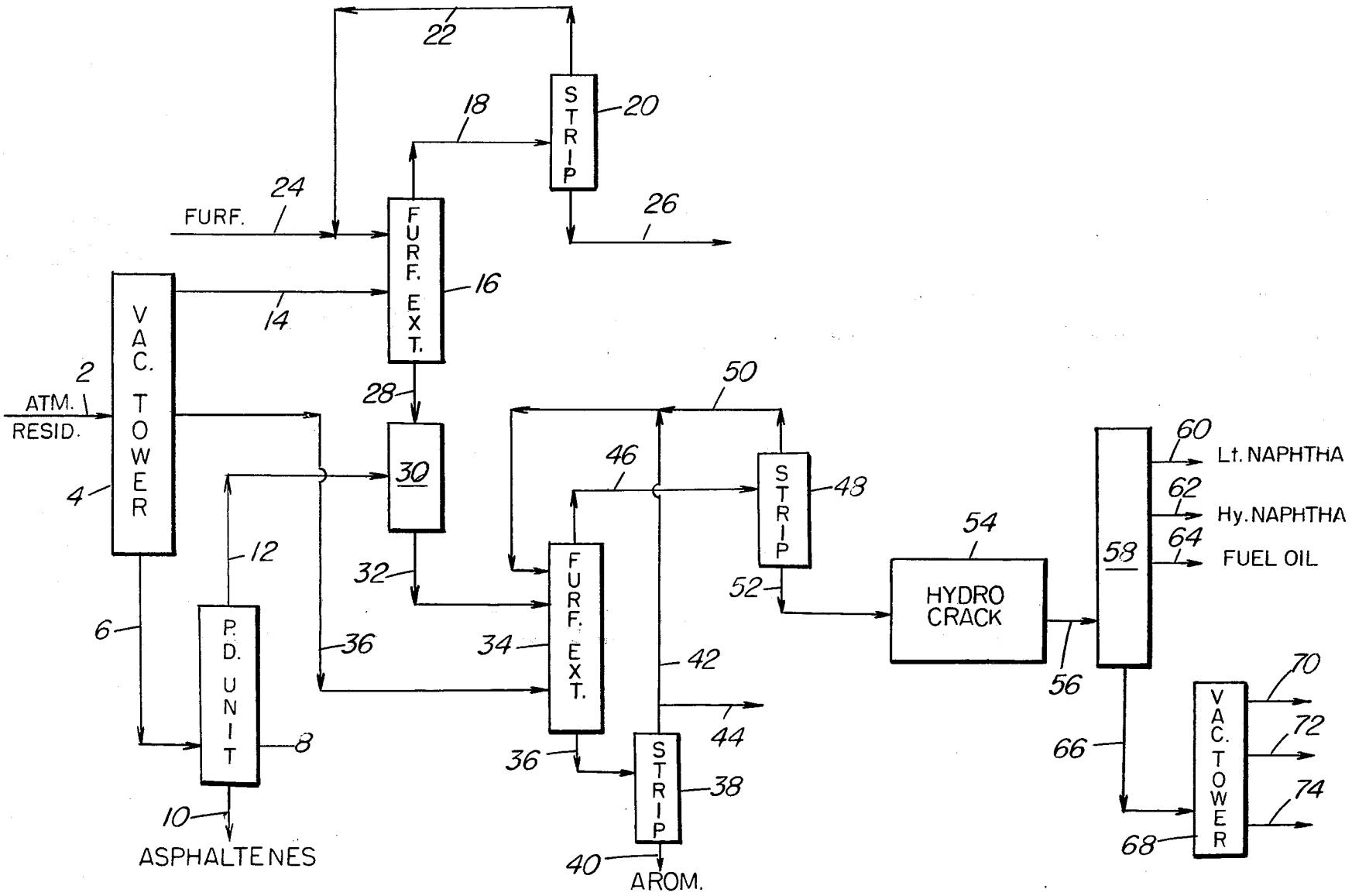
ATM. RESID.
2
VAC. TOWER
4
6
P.D. UNIT
8
10
ASPHALTENES
12
FURF.
24
14
FURF. EXT.
16
28
30
32
36
18
22
STRIP
20
26
34
FURF. EXT.
36
46
STRIP
38
40
AROM.
42
44
50
STRIP
48
52
HYDRO CRACK
54
56
58
66
68
60
Lt. NAPHTHA
62
Hy. NAPHTHA
64
FUEL OIL
VAC. TOWER
70
72
74

PRODUCTION OF LUBRICATING OILS

BACKGROUND OF THE INVENTION

The production of lubricating oils by solvent refining deasphalting a vacuum residium and hydrocracking have been exposed by the prior art in various combinations. Some prior art patents related to the combination include U.S. Pat. Nos. 2,925,374; 3,293,169; 3,328,287; 3,723,295; 3,806,445; and 3,816,295. The present invention is considered to be an improved operating combination over these patents for the production of lube oils.

SUMMARY OF THE INVENTION

The present invention is concerned with the production of lube oils from residual oils. More particularly, the present invention is directed to improving the efficiency of residual oil upgrading for the production of different lube oil products by the combination of deasphalting, solvent extraction and hydrocracking. In a particular aspect the present invention is concerned with upgrading the residual oil product of a crude oil distillation tower by processing the residual oil initially through a vacuum distillation tower to obtain desired selective fractions thereafter processed in a combination of selective solvent extraction operations promoting the recovery of desired component fractions suitable for conversion by hydrocracking to lube oil products.

The drawing is a diagrammatic illustration in elevation of the general process combination of the present invention. Various pumps, valves and other details not going to the essence of the invention have been eliminated for purposes of simplification.

Referring now to the drawing, by way of example, a residual oil product of crude oil distillation such as an atmospheric residual oil product is introduced to the process by conduit 2 communicating with a vacuum distillation tower 4. The vacuum distillation tower 4 is maintained at a top temperature of about 715°F. and a pressure of about 8 mm Hg. In vacuum tower 4, the charged atmospheric resid is separated to permit the recovery of a light vacuum gas oil boiling in the range of about 650° to about 850°F; a heavy vacuum gas oil boiling in the range of about 850° to about 1100°F. and a bottoms fraction boiling above about 1100°F. The choice of these cut points are to some extent, influenced by the over-all lube product slate desired. Propane dissolves hydrocarbons near its critical temperature while rejecting asphaltic materials. It dissolves smaller molecules in preference to large and raising the temperature reduces its dissolving capacity but improves selectivity. Increasing the propane to oil ratio also increases the sharpness of the separation. The vacuum tower bottoms fraction is withdrawn by conduit 6 and passed to a propane deasphalting unit 8. Asphaltenes separated and rejected by the propane in P.D. unit 8 are removed from the bottom thereof by conduit 10. A raffinate product which has been separated from propane solvent is recovered in recovery equipment of the P.D. unit and removed by conduit 12 for treatment in a manner more fully disclosed below. The propane deasphalting unit 8 is operated generally at a temperature within the range of about 120° to 150°F., a pressure within the range of 400 to 650 psig and a solvent to oil ratio in the range of 5–10 to 1 and normally about 7 to 1.

A light vacuum oil product separated in vacuum distillation zone (tower) 4 is withdrawn by conduit 14 for passage to a solvent extraction zone 16. In zone 16, the 650°–850°F. oil product is contacted with furfural solvent introduced by conduit 24 under conditions including a temperature within the range of 180°F. to about 200°F. and a pressure within the range of 0 to 50 psig. Solvent to oil ratio in the range of 1.5–2 to 1 are used. In solvent extraction zone 16, some aromatic constituents in the light vacuum oil feed are separated from the oil feed material and a raffinate product thereof is recovered and removed by conduit 18 communicating with stripping zone 20 wherein solvent retained in the raffinate phase is separated therefrom by stripping at a temperature of about 235°F. under about 0 psig pressure conditions. The stripped solvent is recovered and recycled by conduit 22 to conduit 24 communicating with zone 16. Fresh or regenerated furfural solvent is added to the process by conduit 24. The solvent extracted and stripped light vacuum gas oil product is removed from the stripping zone 20 by conduit 26 for passage to lube producing and blending facilities not shown.

It is often advantageous to expand lube refining capacity by adding hydrocracking rather than a new train of solvent refining facilities because it has been recognized that the qualities of solvent refined and hydrocracked lubes are complementary in nature. A hydrocracked lube product is considered to be excellent for producing high quality industrial oil such as turbine oil and circulating oil by virtue of its cleanliness and also high quality multigrade automotive oil due to its high (VI) viscosity index and high shear stability characteristic. On the other hand, solvent refined oil is considered particularly suitable for high temperature applications.

It has been recognized, however, that using the bottom of the barrel (atmospheric tower bottoms) for lube oil production and cutting deeper into the barrel in order to improve the yields per barrel does not proceed without its difficulties. That is, data suggest that some types of aromatic ring compounds have an adverse effect on the overall hydrocracking operation by requiring severe hydrocracking operating conditions thereby reducing lube product yields. It is believed that these undesired compounds are the polyfused ring aromatic compounds. Deasphalting of the residual oil charge along with the removal of undesired aromatic compounds considerably enhances the hydrocracking operation and lube oil products obtained therefrom by permitting the use of less severe operating conditions which reduce over-cracking of the feed components.

The particular solvent selected for the removal of undesired aromatics may be selected from several different solvents disclosed in the prior art, it being generally preferred to rely upon the use of furfural and phenol solvents. Without exception, the materials being processed having a boiling point above about 1000°F. should be first deasphalted before the aromatic extraction. Known techniques for increasing solvent selectivity for aromatics above and beyond that described herein may be used with advantage. The temperature and solvent dosage of the extraction operation are interdependent variables but both are effected by the composition of the particular fraction being extracted. The present invention and sequence of solvent extraction steps are arranged to improve upon these variables along with economic enhancement of the process.

In the combination operation of the present invention, furfural is employed as the preferred solvent and it is cascaded through a sequence of solvent extraction steps arranged to improve upon the selectivity of the product raffinate recovered from each extraction zone in combination with promoting the efficient utilization of the solvent charged to the combination process. In the operating combination of this invention, the furfural extract of zone 16 is passed by conduit 28 for admixture with the raffinate product of the propane deasphalting zone 8 in conduit 12 in a mixing zone 30. The mixture thus formed is then passed by conduit 32 to a second furfural extraction zone 34 wherein contact is made with the recovered heavy vacuum gas oil fraction boiling from about 850°F. to about 1100°F. and passed by conduit 36 from zone 4 to zone 34. It is contemplated passing the oil fraction in conduit 36 to the lower portion of zone 16. The second furfural extraction zone is maintained at a temperature within the range of 180° to 200°F.; a pressure within the range of 10 to 50 psig and a solvent to oil ratio in the range of 0.5–2/1. Thus in the arrangement of this invention the furfural solvent recovered from the light gas oil solvent extraction step is cascaded to the heavy gas oil extraction operation without any intermediate separation or purification of the furfural solvent. The cascaded solvent is mixed with the P.D. (propane deasphalt) raffinate in one embodiment before passing the solvent to the second extraction zone wherein the mixture and solvent are brought in contact with heavier vacuum gas oil fraction.

The improved solvent extraction combination of the present invention improves upon the quality of the feed to be hydrocracked and such an improvement provides an improved yield of lube product provided in part by milder hydrocracking severity conditions. Thus it is estimated that the yield of lube base product may be increased by about 10 percent based on feed charged to the hydrocracking operation if in the combination operation about 10 percent of the most refractory compounds are removed from the raw feed. In addition it is estimated that the hydrocracking operating pressure conditions can be lowered from about 3000 psig to about 2000 psig and the temperature reduced by about 25° to 50° thereby permitting substantial savings in capital investment and operating costs.

To assist with accomplishing the ends above discussed, the second solvent extraction zone 34 provided in the combination operation is maintained at a temperature within the range of about 120°F. to about 150°F. and a pressure in the range of about 10 to 50 psig. Solvent ratios may be within the range of 0.5–2/1. In solvent extraction zone 34, a portion of the aromatics and particularly the undesired highly refractory polycyclic aromatics are removed by the solvent and withdrawn from the bottom of the zone as an extract phase removed by conduit 36 for passage to a solvent recovery stripping zone 38. In zone 38, the solvent is recovered from the aromatics at a temperature of about 235°F. and about 0 psig pressure. The aromatics separated from the furfural solvent are removed from the stripper by conduit 40. Recovered solvent is removed by conduit 42 for recycle to an upper portion of the solvent extraction zone 34. A portion of the recovered solvent may be withdrawn by conduit 44 and either with or without further purification thereof by recycled to extraction zone 16 by conduit 24.

A raffinate phase comprising hydrocarbons boiling in the range of about 800°F. to 1000°F. and separated from asphaltic and polycyclic aromatic components is recovered from the upper portion of extraction zone 34 by conduit 46. This raffinate phase is passed to stripper 48 maintained at a temperature of about 235°F. and 0 psig pressure. In stripper 48, entrained furfural solvent is separated from the raffinate phase comprising the desired hydrocarbon components boiling above about 800°F. to be used as feed to a hydrocracking operation. The stripped solvent is recovered by conduit 50, combined with the solvent in conduit 42 and recycled to the upper portion of solvent extraction zone 34.

The hydrocracking feed refined as discussed above is withdrawn from stripper 48 by conduit 52 and passed to a hydrocracking operation represented by 54. In hydrocracking zone 54 the solvent refined charge provided by conduit 52 is subjected to selective hydrocracking conversion conditions directed to producing lube oil product materials and preferably are relatively mild hydrocracking conditions which will enhance the yield thereof. The hydrocracking conditions may be varied considerably depending upon the results desired and the composition of the feed passed thereto. Thus, the operating conditions may be selected from a temperature within the range of 700°F. to about 850°F.; a hydrogen partial pressure within the range of about 800 psi to about 3000 psi; a space velocity within the range of 0.05 to about 1.5 v/v/hr. It is preferred however as discussed above to select relatively mild processing conditions and particularly those conditions enhancing the yield of desired lube oil products. In a specific application it is proposed to employ a temperature of about 725°F. at a pressure of about 2000 psig in the presence of cobalt-molybdena dispersed in a silica zirconia matrix as the catalyst.

The catalyst employed in the hydrocracking operation may be substantially any of the known hydrocracking catalysts which promote the reactions desired. It is preferred to employ an acid hydrocracking catalyst promoted with a Group VIII metal component. Other suitable catalysts include the oxides and sulfides of the metals of Group VI used alone or in the admixture with the Group VIII metal. Mixtures including one or more components of chromium sulfide, molybdenum sulfide, tungsten sulfide and the oxides and sulfides of iron, cobalt, nickel, palladium, platinum, rhodium, osmium, iridium may be used. These materials and mixtures thereof may be deposited or dispersed on a suitable carrier material, preferably, an acidic carrier material such as a crystalline zeolite, amorphous silica alumina mixtures, silica zirconium, alumina alone or promoted with a compound such as boria and/or a halogen promoter such as bromine, chlorine, and fluorine.

During the hydrocracking operation and depending upon the severity of that operation lube oil products and lower boiling products of the hydrocracking operation are formed and require separation. To accomplish this end the product effluent of the hydrocracking operation is passed through a sequence of separation zones of decreasing pressure and selected to particularly optimize the separation desired. Thus the product effluent is passed to a first high pressure separation zone to obtain the recovery of a high pressure hydrogen rich stream which is recycled to the hydrocracking operation. A relatively high pressure product stream reduced in hydrogen rich recycle gas is recovered and then passed to another lower pressure separation zone for the recovery of gasiform material from liquid material before passing the liquid hydrocracked product to a sequence of product distillation zones.

Separation of the product of hydrocracking in the combination of the present invention goes to the essence of applicant's invention only to the extent that it permits the recovery of lube oil products of hydrocracking boiling above about 650°F. from lower boiling components of the conversion operation such as fuel oil products along with light and heavy naphtha products of the hydrocracking operation. Thus in the combination of this invention the product of hydrocracking after preliminary desired separation steps is passed to a first product distillation zone 58 by conduit 56 wherein a separation is made to recover a light naphtha product withdrawn by conduit 60; a heavy naphtha product withdrawn by conduit 62; a fuel oil product withdrawn by conduit 64 and a bottoms product withdrawn by conduit 66. Separation of the product as above provided may be accomplished at a temperature within the range of 650°F. to about 750°F. at a pressure within the range of 0 to 15 psig.

The bottoms product boiling above about 650°F. withdrawn by conduit 66 is then passed to a distillation zone 68 maintained under conditions to particularly obtain a separation of the heavy product into desired lube oil fractions. In distillation zone 68, maintained at a temperature in the range of 675°F. to 725°F. and a pressure of about 8 mm Hg(mercury), the heavy lube oil fraction of hydrocracking is separated. In one specific embodiment a separation is made to recover by conduit 70, a material boiling in the range of 650° to 850°F.; by conduit 72, a material boiling in the range of 850° to 1000°F. is recovered; and by conduit 74, a material boiling above about 1000°F. is recovered. These materials are dewaxed and passed to lube blending facilities now shown.

Having thus generally described the invention and presented a specific example in support thereof, it is to be understood that no undue restrictions are to be imposed by reason thereof except as provided by the following claims.

I claim:

1. A method for producing lube oils from an atmospheric residual oil which comprises, separating an atmospheric residual oil to recover a light vacuum gas oil, a heavy vacuum gas oil and a resid containing asphaltic material, deasphalting said resid to provide a first raffinate product thereof, solvent extraction said light vacuum gas oil to provide a second raffinate phase and a first extract phase, separating solvent from said extracted light vacuum gas oil, combining said first extract phase with said first raffinate product of said resid deasphalting operation to form a mixed oil phase comprising solvent with extracted polycyclic aromatics, using said mixed oil extract phase with solvent to remove undesired aromatics from said heavy vacuum gas oil in a second solvent extraction zone, recovering a second extract phase from said second solvent extraction zone and separating solvent from aromatics in said second extract phase, recycling solvent thus separated to said second solvent extraction zone, recovering a third raffinate phase from said second solvent extraction zone and separating solvent from an oil phase comprising said third raffinate and boiling above about 800°F., recycling solvent thus separated to said second extraction zone, passing said oil phase boiling above about 800°F. to a hydrocracking zone maintained under relatively mild hydrocracking conditions selected to enhance the yield of lube oil base products and separating a product of said hydrocracking operation boiling above about 650°F into a plurality of separate boiling range lube oil fractions.

2. The method of claim 1 wherein fresh furfural solvent is added to said first solvent extraction zone and is cascaded with solvent removed aromatics to said second solvent extraction zone processing a heavy vacuum gas oil.

3. The method of claim 1 wherein the raffinate product of solvent refined light vacuum gas oil separated from solvent and the 650°F plus lube oil products of the hydrocracking operation are blended for the production of turbine oil and multi-grade automotive lube oils.

4. The method of claim 1 wherein the product of hydrocracking boiling above about 650°F is separated to recover a first lube oil fraction boiling in the range of 650°to 850°F, a second lube oil fraction boiling in the range of 850°–1000°F and a third fraction boiling above 1000°F.

5. The method of claim 4 wherein one or more of the separated lube oil fractions are dewaxed.

* * * * *